United States Patent [19]

Johnson et al.

[11] Patent Number: 4,898,191

[45] Date of Patent: Feb. 6, 1990

[54] SMOKING DEVICE

[75] Inventors: Robert R. Johnson; Tilford F. Riehl, both of Louisville, Ky.

[73] Assignee: Brown & Williamson Tobacco Corporation, Louisville, Ky.

[21] Appl. No.: 281,584

[22] Filed: Dec. 9, 1988

[51] Int. Cl.[4] ..... A24B 15/00

[52] U.S. Cl. ..... 131/359; 131/360

[58] Field of Search ..... 131/359, 360, 364

[56] References Cited

U.S. PATENT DOCUMENTS 4,714,082 12/1987 Banarjee et al. ..... 131/359

FOREIGN PATENT DOCUMENTS 2064296 6/1981 United Kingdom ..... 131/364

*Primary Examiner*—Vincent Millin

*Assistant Examiner*—Jennifer L. Doyle

*Attorney, Agent, or Firm*—Charles G. Lamb

[57] ABSTRACT

A smoking device having a fuel column circumscribed by a wrapper has a passage with an impermeable wall extending concentrically therethrough and a filter rod at one end of the fuel column in flow communication only with the passage. The passage is filled with a material including an aerosol releasing material. The filter is formed with a pocket coaxial with the tube and the pocket is filled with highly flavorful tobacco.

10 Claims, 1 Drawing Sheet

SMOKING DEVICE

BACKGROUND OF THE INVENTION

The present invention relates to smoking devices, and more particularly, to a smoking article which includes flavor releasing material and aerosol generating material which are volatilized by the heat generated by burning tobacco, but are not directly subjected to the burning tobacco.

Smoking articles have a tobacco column with a tubular member therethrough, wherein the tube is filled with an aerosol releasing material, are known. The following patents illustrate various known smoking articles of this type: U.S. Pat. No. 3,258,015 issued on June 28, 1966 to C. D. Ellis, et al.; U.S. Pat. No. 3,356,094 issued on Dec. 5, 1967 to C. D. Ellis, et al.; U.S. Pat. No. 4,340,072 issued on July 20, 1982 to Bolt, et al.; U.S. Pat. No. 4,714,082 issued on Dec. 22, 1987 to Chandra K. Banerjee, et al.; U.S. Pat. No. 4,715,389 issued on Dec. 29, 1987 to Dwo Lynn, et al.; and U.S. Pat. No. 4,732,168 issued on Mar. 22, 1988 to James L. Resce, et al.

In U.S. Pat. Nos. 3,356,094; 4,340,072 and 4,732,168 smoke from the burning tobacco is mixed with the aerosol and delivered to the smoker's mouth. In U.S. Pat. No. 4,715,389, a tobacco column has a central channel which holds a plug of carbonized tobacco with plugs of aluminum screen to both sides of the tobacco plug. Both smoke from the tobacco column and pyrolized products of the carbonized tobacco plug are delivered to the smoker's mouth. In U.S. Pat. No. 3,258,015, the aerosol from a nicotine-releasing composition located within a central tube passes through a nucleating chamber wherein the aerosol is cooled and condensed to droplets before being discharged to the smoker's mouth.

SUMMARY OF THE INVENTION

The present invention provides a smoking device having a central passage having an impermeable wall formed within a fuel column, wherein the central passage contains a material which includes a flavor releasing material and an aerosol releasing material, and a filter rod located at one end of the fuel column formed with a pocket filled with a highly flavorful tobacco.

More particularly, the present invention provides a smoking device comprising a fuel column, a wrapper circumscribing the fuel column, a passage having an impermeable wall coaxially extending through the fuel column, a filter rod coxially located at one end of the fuel column in fluid flow communication only with the passage, a pocket formed in the filter rod, and highly flavorful tobacco filling the pocket.

BRIEF DESCRIPTION OF THE DRAWINGS

A better understanding of the invention will be had upon reference to the following description in conjunction with the accompanying drawings wherein like numerals refer to like parts through the several views and wherein.

DETAILED DESCRIPTION OF THE PREFERRED EMBODIMENT

Figure 1:
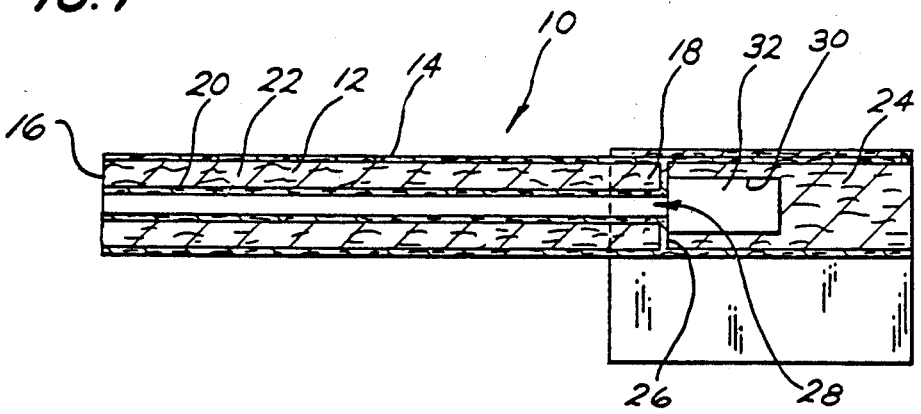
FIG. 1 is a longitudinal cross-sectional view of one embodiment of the present invention.

With reference to FIG. 1, there is shown a smoking device, generally denoted as the numeral 10, of the present invention. The smoking device 10 comprises a generally cylindrical tobacco column 12 circumferentially wrapped with a paper wrapper 14 having flow through ends 16 and 18. The paper wrapper 14 is preferably of the type having a controlled burning rate which emits little visible smoke, commonly referred to as sidestream smoke.

A tube 20 of impermeable material coaxially extends entirely through the tobacco column 12 with one end of the tube 20 open to one end 16 of the tobacco column 12 and the other end of the tube 20 open to the other end 18 of the tobacco column 12.

The tube 20 is filled with a non-combustible granular material 22 such as alumina or charcoal. The granular material 22 is coated with an aerosol generating material such as, for example, glycerin and lactic acid, and lipophilic materials such as methyl palmitate which is aerosolized at the smoldering temperature of the tobacco of the tobacco column 12. A flavor releasing material such as a nicotine extract or menthol can also coat the granular material 22.

A filter rod 24 is coaxially located at one end 18 of the tobacco column 12 and is attached thereto by a tipping material 26 circumscribing the filter rod 24 and overlapping the tobacco column 12 at the tobacco column end 18. The filter rod 24 can be fabricated of virtually any convenient material, for example, cellulose acetate and the like, typically used as filter media for cigarettes.

The filter rod 24 is in flow communication only with the tube 20, but not the tobacco column 12. Toward this objective, a barrier or seal is located at the interface of the filter rod 24 and the tobacco column 12 which has an opening 28 in alignment with the tube 20.

The filter rod 24 if formed with a pocket 30 in coaxial alignment with the tube 20. The pocket 30 is filled with a flavor releasing material 32 such as a highly flavorful tobacco. As shown in FIG. 1, the pocket 30 is open to the tube 20.

Figure 2:
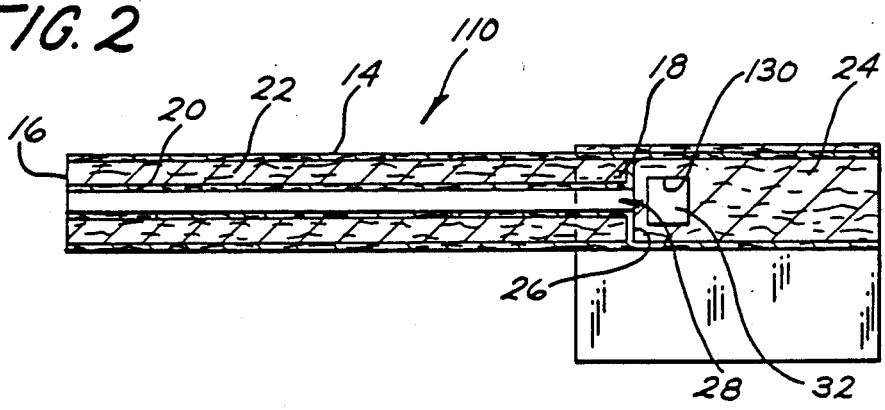
FIG. 2 is a longitudinal cross-sectional view of another embodiment of the present invention; and, FIG. 3 is a longitudinal cross-sectional view of another embodiment of the present invention.

With reference to FIG. 2, there is shown a smoking device, generally denoted as the numeral 110, which is identical to the smoking device 10 of FIG. 1 except for one feature and, therefore, the identical components therebetween are identified by identical numerals and for the sake of brevity the description thereof will not be repeated. The difference between the smoking device 110 and smoking device 10 is that the filter rod 24 of the smoking device 110 is formed with a pocket 130 which is not open directly to the tube 12, but is surrounded on all sides by the filter material of the filter rod 24.

When the tobacco column 12 is ignited, and a smoker puffs on the filter rod 24, air and some tobacco smoke are drawn through the tube 20. The heated air passing through the granular material 22 in the tube 20 aerosolizes the aerosol generating material, and vaporizes the flavor releasing material when employed. The aerosol and released flavor pass from the tube 20 past the barrier 26 and into the filter rod 24. In the embodiment of FIG. 1, the air carrying the flavored aerosol passes in a jet stream into the pocket 30 wherein it is dispersed by the tobacco material 32 in the pocket 30 and picks up flavor from the tobacco material 32 as it passes therethrough. The air carrying the aerosol then passes from the pocket 30 through the filter material of the filter rod 24 and into the smoker's mouth. In the embodiment of FIG. 2, the sequence of events is identical except that as the air carrying the aerosol passes in a stream from the tube 20 is passes through the filter material of the filter rod 24 upstream of the pocket 130 which disperses the aerosol before this air passes through the pocket 130.

Figure 3:
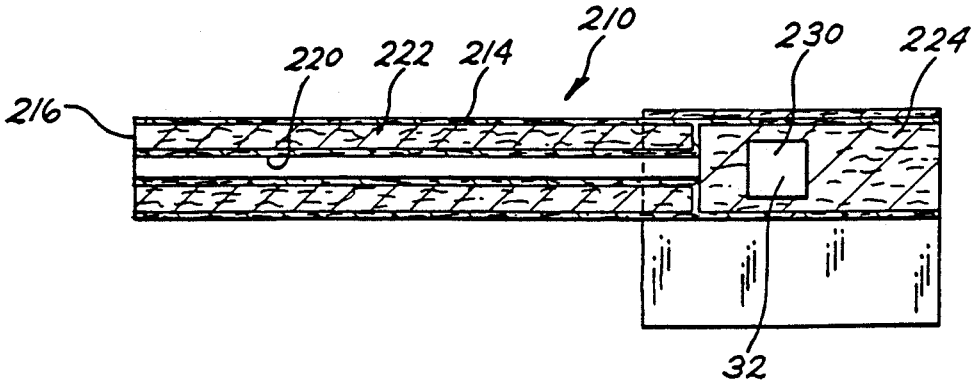

With reference to FIG. 3, there is shown another embodiment of the present invention of a smoking device, generally denoted as the numeral 210. The smoking device 210 comprises a generally cylindrical fuel column 212 fabricated of an impermeable, non-tobacco fuel such as charcoal and the like. It is contemplated that the fuel column 212 can be circumscribed by a paper wrapper 214 such that the fuel column 212 has the appearance of a conventional tobacco column of a conventional cigarette.

A passage 220 is concentrically formed entirely through the fuel column 212. Passage 220 is provided with opposed openings at the ends 216, 218 of the fuel column 212. The impermeable fuel of the fuel column 212 defines an impermeable wall of the passage 220. Furthermore, the passage 220 is filled with a flavor releasing material 222 such as, for example, a tobacco or a flavor coated granulated material and an aerosol generating material.

A filter rod 224 is coaxially located at one end 218 of the fuel column 212 and is attached thereto by a tipping material 226 circumscribing the filter rod 224 and overlapping the fuel column 212 at the fuel column end 218. The filter rod 224 can be fabricated of virtually any convenient material, for example, cellulose acetate and the like. The filter rod 224 is in fluid flow communication with the passage 220, but not the fuel column 212 because the fuel column 212 is itself impermeable.

The filter rod is formed with a pocket 230 in coaxial alignment with the passage 220. The pocket 230 is filled with a flavor releasing material 232 such as a highly flavorful tobacco. As shown in FIG. 3, the pocket 230 is formed in the filter rod 224 completely surrounded by the filter material of the filter rod 224. It is contemplated that the pocket 230 can be formed in the filter rod 224 open to the passage 212 as shown in the embodiment of FIG. 2.

As with the previously described embodiments of FIGS. 1 and 2 above, when the fuel column 212 is ignited, and a smoker puffs on the filter rod 224, air is drawn through the passage 220. The heated air passing through the material 222 in the passage 220 picks up the flavor from the flavor releasing material 222 and aerosolizes the aerosol generating material if utilized. The air passes from the passage 220 and into the filter rod 224 wherein it is dispersed and passes through the pocket 230 picking up additional flavor from the releasing material 232 in the pocket 230.

The flavor carrying air then moves out of the pocket 230 through the portion of the filter rod 224 downstream of the pocket 230 and into the smoker's mouth.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A smoking device comprising:

a fuel column;

means defining a passage concentrically extending entirely through the fuel column having an impermeable wall;

a flavor releasing material filling the passageway;

a filter rod located at one end of the fuel column coaxial therewith, the filter rod being in flow communication only with the passage;

a pocket formed in the filter rod in coaxial alignment with the passage; and, a flavor releasing material filling the pocket.

2. The smoking device of claim 1, wherein the pocket is open to the passage.

3. The smoking device of claim 1, wherein the pocket is surrounded by the filter material of the filter rod.

4. The smoking device of claim 1, wherein the fuel column comprises an impermeable non-tobacco fuel and the wall of the passage is defined by the impermeable fuel material.

5. The smoking device of claim 1, wherein the flavor releasing material in the passage including tobacco.

6. The smoking device of claim 1, wherein the flavor releasing material is a flavor coated granular material.

7. The smoking device of claim 1, further comprising an aerosol generating material in the passage.

8. The smoking device of claim 1, wherein the flavor releasing material filling the pocket in the filter rod is tobacco.

9. The smoking device of claim 1, wherein the fuel column is tobacco; and the passage is defined by a tube of an impermeable material.

10. The smoking device of claim 9, further comprising barrier means at the interface of the tobacco column and filter rod preventing flow communication from the tobacco column to the filter rod.

* * * * *